US011111694B2

(12) United States Patent
Nickelston et al.

(10) Patent No.: US 11,111,694 B2
(45) Date of Patent: Sep. 7, 2021

(54) SAFETY DEVICE FOR GUARD RAIL

(71) Applicant: Andrew W. Nickleson, Lawsonville, NC (US)

(72) Inventors: Andrew W. Nickelston, Lawsonville, NC (US); Terry R. Cundiff, Martinsville, VA (US); Starlett Hedrick, Axton, VA (US)

(73) Assignee: Andrew W. Nickelston, Lawsonville, NC (US)

( * ) Notice: Subject to any disclaimer, the term of this patent is extended or adjusted under 35 U.S.C. 154(b) by 567 days.

(21) Appl. No.: 16/003,510

(22) Filed: Jun. 8, 2018

(65) Prior Publication Data

US 2018/0355632 A1 Dec. 13, 2018

Related U.S. Application Data

(60) Provisional application No. 62/626,957, filed on Feb. 6, 2018, provisional application No. 62/517,641, filed on Jun. 9, 2017.

(51) Int. Cl.

| | |
|---|---|
| ***E04H 17/20*** | (2006.01) |
| ***E01F 15/14*** | (2006.01) |
| ***E01F 15/04*** | (2006.01) |
| *E04H 17/00* | (2006.01) |

(52) U.S. Cl.

CPC ..... *E04H 17/20* (2013.01); *E01F 15/0469* (2013.01); *E01F 15/143* (2013.01); *E04H 17/006* (2021.01)

(58) Field of Classification Search

CPC ..... E04H 2017/006; E04H 17/20; E01F 15/0469; E01F 15/143

USPC ..... 52/301

See application file for complete search history.

(56) References Cited

U.S. PATENT DOCUMENTS

| | | | | |
|---|---|---|---|---|
| 574,755 | A * | 1/1897 | Oehler | A47J 45/074 16/433 |
| 1,798,753 | A * | 3/1931 | Paque | E04H 17/20 52/301 |
| 5,950,761 | A | 9/1999 | Murphy | |
| 6,543,750 | B1 * | 4/2003 | Calzone | E04H 17/20 256/1 |
| 6,691,479 | B1 * | 2/2004 | Tscharner | A01G 17/14 135/118 |
| 6,902,151 | B1 | 6/2005 | Nilsson | |
| 7,500,653 | B1 * | 3/2009 | Hartman | E04H 17/24 256/1 |
| 7,511,227 | B2 * | 3/2009 | Ritchie | H02G 3/263 174/158 F |
| 8,113,473 | B2 * | 2/2012 | Bradley | F16B 9/02 248/121 |
| 8,782,980 | B1 | 7/2014 | Fajardo | |
| 9,010,049 | B1 * | 4/2015 | Redman | F21S 8/081 52/301 |
| 10,227,747 | B2 * | 3/2019 | Herdman | E02D 5/223 |
| 10,822,799 | B2 * | 11/2020 | Ryan | E04G 21/32 |

(Continued)

*Primary Examiner* — Matthew R McMahon

(74) *Attorney, Agent, or Firm* — Coats & Bennett, PLLC

(57) ABSTRACT

A safety device functions as a cap that is inserted over the exposed end of an I-shaped support post. The safety device comprises a generally L-shaped cap including a front pad that covers the flange of the support post, and a top pad that covers the exposed end of the support post when the safety device is installed onto the support post.

19 Claims, 16 Drawing Sheets

(56) References Cited

U.S. PATENT DOCUMENTS

| | | | | |
|---|---|---|---|---|
| 2002/0182008 | A1* | 12/2002 | Roller | E01F 15/0469 404/6 |
| 2012/0043516 | A1 | 2/2012 | Ashmead | |
| 2013/0019537 | A1* | 1/2013 | Falcone | E01F 13/028 49/463 |

* cited by examiner

SAFETY DEVICE FOR GUARD RAIL

TECHNICAL FIELD

The present invention relates generally to roadside guardrails and, more particularly, to a safety cap for a roadside guardrail to prevent injury to pedestrians and cyclists.

BACKGROUND

Roadside guardrails are placed along many highways and roadways to prevent vehicles from colliding with roadside obstacles, veering off into ditches or down steep embankments, and hitting pedestrians or cyclists traveling along the road. The most common type of roadside guardrail is the strong post, blocked out W-beam guardrail. This type of guardrail comprises a generally horizontal beam supported at spaced locations by posts. A wood block or other spacer is disposed between the posts and the horizontal rail to space the rail from the posts.

While guardrail systems have greatly improved highway safety and have reduced fatalities in accidents, the current design of guardrail systems still present a hazard to pedestrians and cyclists. The guardrail is usually set at a height to keep a car from jumping over the rail. However, the typical height of the guardrail does not prevent a pedestrian or cyclist from falling over the guardrail and striking one of the support posts. The most common type of support post is a metal I-beam, which has sharp edges and corners that can cause serious injury if a pedestrian or cyclist falls head first into the support post.

A similar problem may also exist with guardrails used as safety barriers at industrial sites and construction sites. Likewise, the end of an exposed beam may present a hazard to workers at industrial sites and construction sites.

SUMMARY

The present invention comprises a safety device that can be applied to the exposed end of any I-shaped support post or beam that presents a safety hazard to humans. For example, the safety device may be applied to the top end of I-shaped support posts commonly used in roadside guardrails or other safety barriers in industrial sites or construction sites. The safety device may also used on the exposed ends of !-shaped beams that present a hazard to workers at industrial sites and construction sites.

In one exemplary embodiment, the safety device comprises a generally L-shaped cap including a front pad that covers the flange of the support post, and a top pad that covers the exposed end of the support post when the safety device is installed onto the support post. The safety device may further include a pair of side panels extending downward from the top pad in a plane perpendicular to the top pad. The side panels define a channel that receives the web of the support post when the safety device is installed onto the support post.

In another exemplary embodiment, the front pad comprises a front wall, back wall, and side walls. The front wall, back wall and side walls form a channel that is configured to receive the flange of the support post. The back wall includes a slot into which the web of the support post slides when the safety device is installed onto the support post.

In another exemplary embodiment, the front pad comprises a front wall, a pair side walls extending along respective edges of the front wall, and a pair of back walls connected to respective side walls by live hinges. The back walls are movable between an open position to facilitate installation and a closed position. In the closed position, the front wall, side walls, and back walls define a channel that receives the flange of the support post when the safety device is installed onto the support post. A slot is formed between the edges of the back walls when the back walls are in the closed position to allow the web of the support post to pass between the back walls.

Once installed, the safety device provides cushioning in the event that a person falls into the support post. Additionally, the corners and edges of the safety device are rounded so that there are no sharp corners or edges to hit. Based on the foregoing, it is apparent that the safety device is inexpensive to manufacture and easy to install, while protecting persons from serious injury.

DETAILED DESCRIPTION

Figure 4:
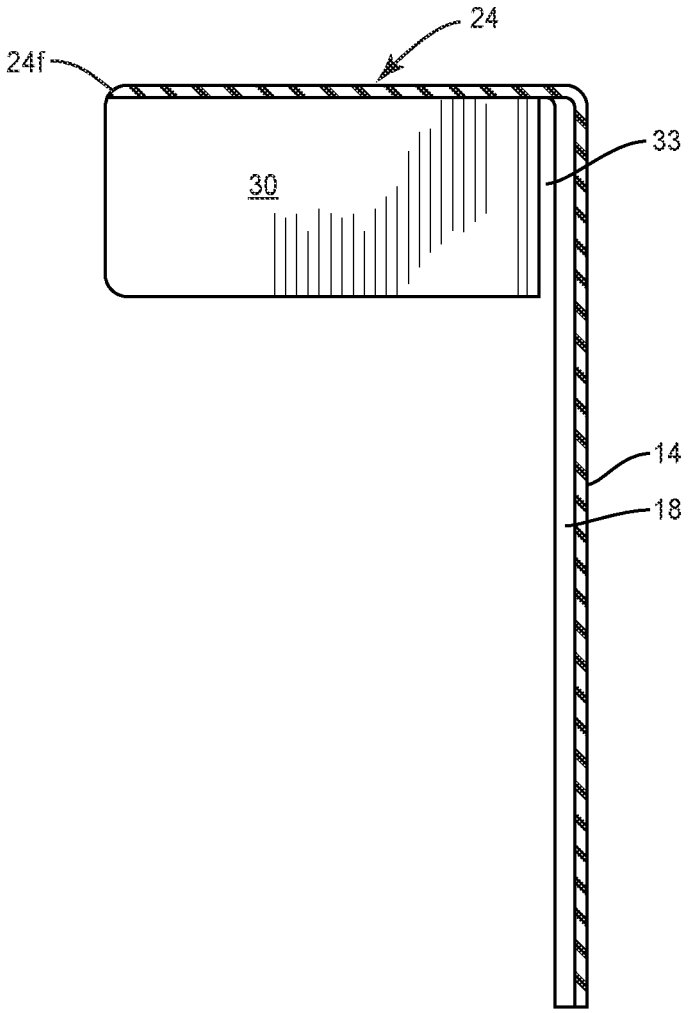
FIG. 4 is a section view of the safety device.

Referring now to the drawings, various embodiments of a safety device indicated generally by the numeral 10 are shown and described. For convenience, similar reference numbers are used throughout the Figures to indicate similar elements or components. The safety device 10 is designed and configured to mount onto an exposed end of an I-shaped support post 5 for a guardrail. The support post 5 (shown in FIGS. 4 and 5) has a generally I-shaped configuration including two flanges 7 interconnected by a central web 9. A guardrail (not shown) is attached to one of the flanges 7, either directly or indirectly using a support block. Typically the top of the guardrail is supported about two feet above the ground.

The support post 5 of the guardrail presents a potential hazard to pedestrians or cyclists that may lose their balance or fall over the guardrail. The sharp edges and corners of the support posts 5 can cause serious injury, particularly if a person falls head first into the support post 5. The safety device 10 is configured to be installed onto the exposed end of the support post 5 to protect pedestrians and cyclists from the most serious injuries.

While the safety device 10 is designed for use with supports posts 5 for guard rails, those skilled in the art will appreciate that the safety device 10 as herein described is more generally applicable to any type of structure having an I-shaped post or beam with an exposed end that presents a safety hazard.

FIG. 1-4 illustrate a first embodiment of the safety device 10. The safety device 10 in FIGS. 1-4 comprises a front pad 12, a top pad 24, and a pair of side panels 30 forming a channel 32. The front pad 12, top pad 24, and side panels 30 are molded as a single unit from a suitable material such as polyvinylchloride (PVC), low density polyethylene, polypropylene, polyurethane, polymeric foam materials, semi-rigid rubber, or other suitable materials. The material is preferably semi-rigid so that it will hold its form while providing some cushioning against impact. The edges and corners of the safety device 10 are preferably rounded to reduce the chance of injury.

Figure 1:
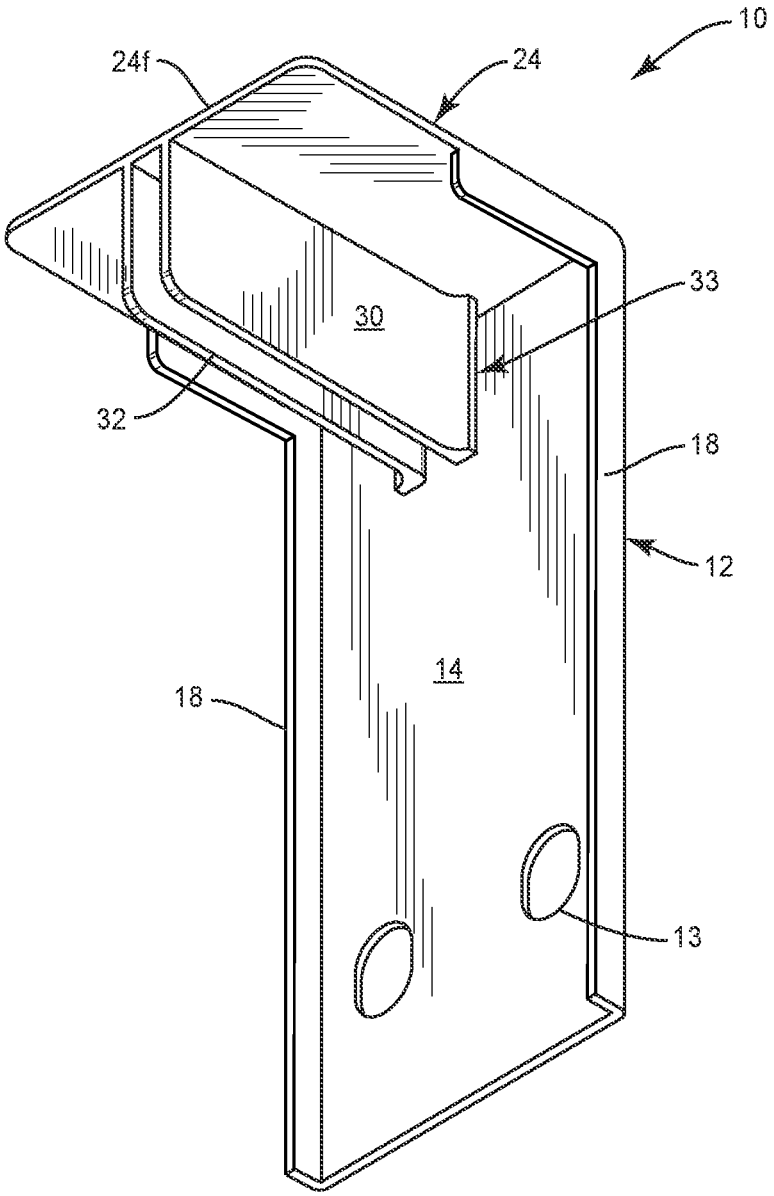
FIG. 1 is a rear perspective view of the safety device according to a first embodiment.
Figure 2:
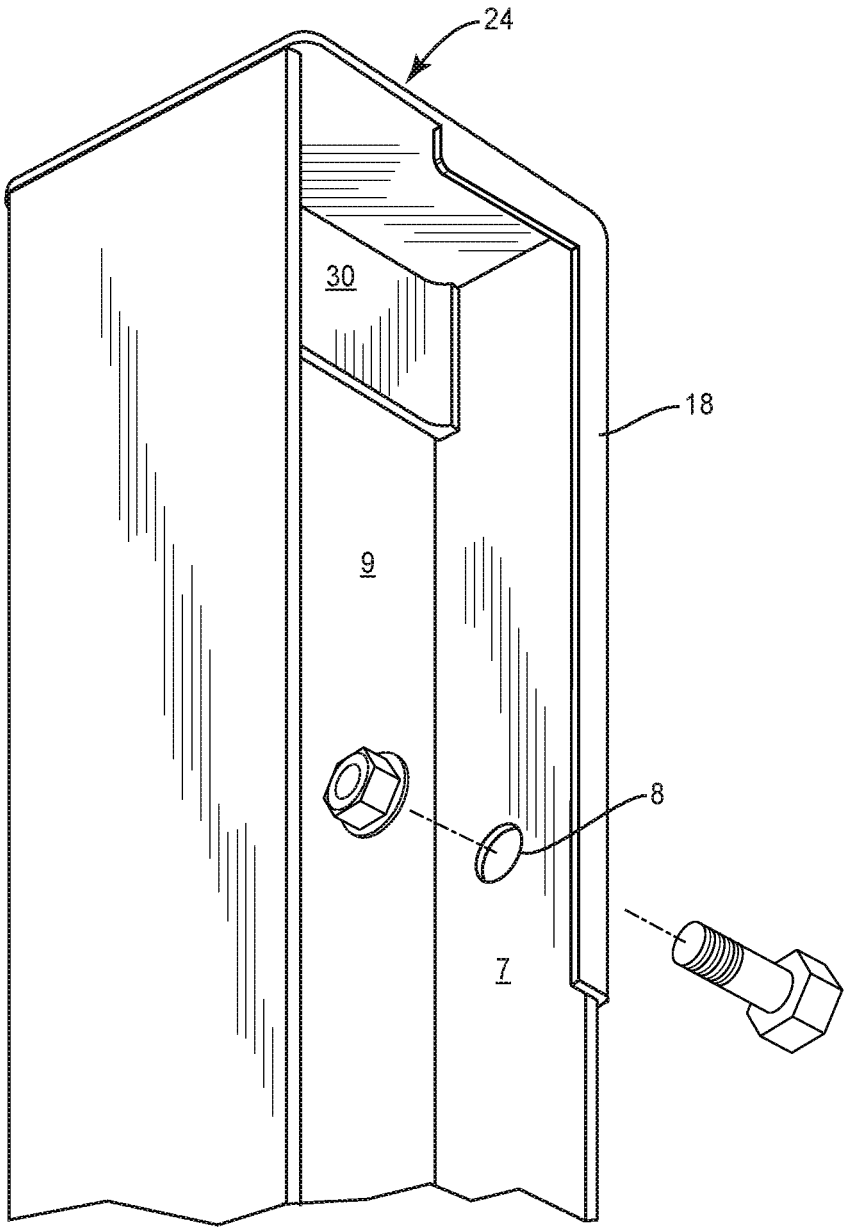
FIG. 2 is a rear perspective view of the safety device installed on a support post according to the first embodiment.
Figure 3:
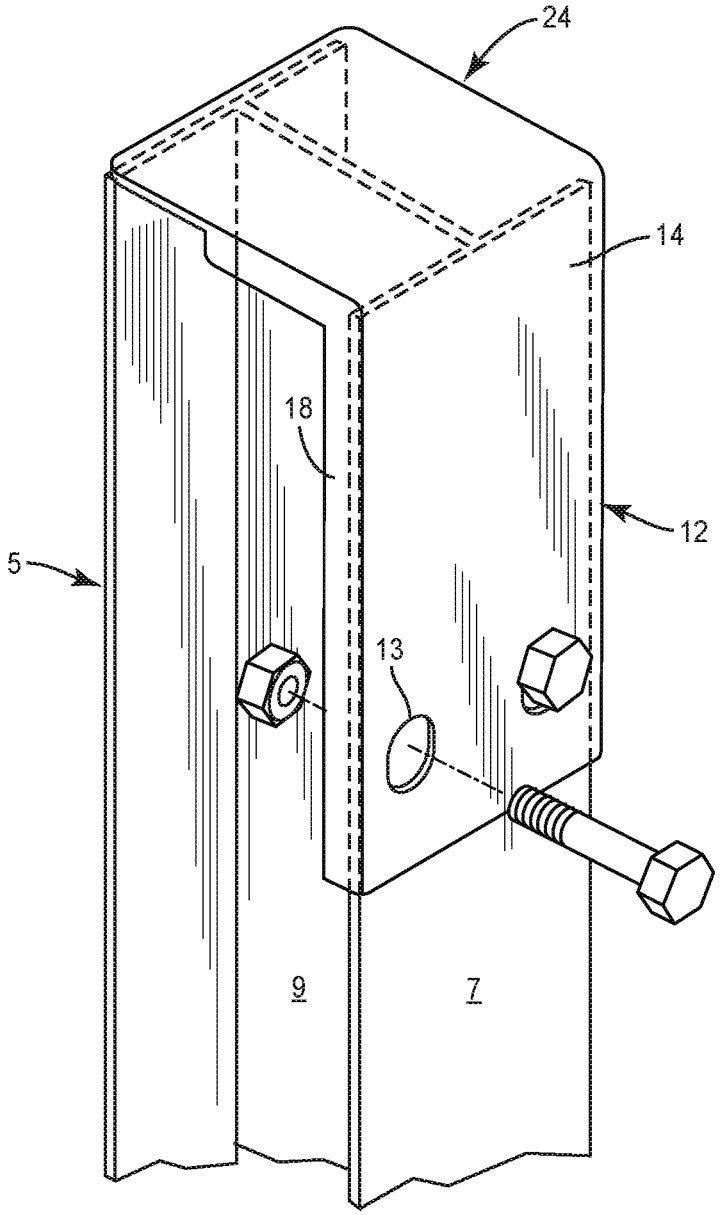
FIG. 3 is a front perspective view of the safety device according to the first embodiment installed on a support post.

The front pad 12 in the embodiment shown in FIGS. 1-4 comprises a generally planar front wall 14 that extends downward from the top pad 24. The front wall is configured to cover the outer surface of a flange 7 of the support post 5. The front wall 14 includes two opening 13, which are used for securing the safety device to the support post 5 as hereinafter described. Side walls 18 extend the lateral edges of the front wall 14 and wrap around the lateral edges of the flange 7 of the support post 5 when safety device 10 is installed on the support post 5. In the embodiment shown in FIGS. 1-4, the side walls 18 have an L-shaped configuration including a first portion that extends along one edge of the front wall 14 and a second portion that extends along the side edge of the top pad 24. When installed on a support post 5 as shown in FIGS. 2 and 3, the side wall 18 wraps around the side edges of the flange 7. Those skilled in the art will appreciate that the side walls 18 could be omitted in some embodiments. Extending the side wall 18 along the top pad 24 provides support for and greater rigidity to the top pad 24.

The top pad 24 in the embodiment shown in FIGS. 1-4 comprises a generally planar panel that projects perpendicularly from the upper end of the front pad 12. The top pad 24 extends longitudinally in cantilever fashion from the front pad 12 and has a free end 24*f* of the top pad 24 disposed distally from the front pad 12. In some embodiments, the top surface of the top pad 24 may be sloped or contoured so that water runs off quickly. For example, the top surface could have a curved or dome shape. Also, the top surface of the top pad 24 could comprise two or more inclined surfaces forming a gable or pyramid shape. When the safety device 10 is installed onto a support post 5 as hereinafter described, the top pad 24 covers the top end of the support post 5. The top pad 24 is shown as being generally rectangular in form. However, those skilled in the art will appreciate that the shape of the top pad 24 is not a material aspect of the invention and that the top pad 24 could have a variety of shapes. For example, the top pad 24 could be triangular, trapezoidal, oval, or virtually any other shape. The side edges of the top pad 24 could be straight or could be curvilinear.

The side panels 30 extend downwardly from the bottom surface of the top pad 24 generally perpendicular to the top pad 24. The side panels 30 define a channel 32 that is open along two sides to receive the upper end of the web 9 of the support post 5 when the safety device 10 is installed on the support post 5. As shown in the Figures, the channel 32 is downwardly open, and is also open ended in a direction from the front pad 12 toward the free end 24*f* of the top pad 24 (generally to the left in FIG. 1). The side panels 30 terminate before reaching the front wall so as to form a gap 33 between the forward end of the side panels 30 and the front wall 14. The gap 33 is shown best in FIG. 4. This gap 33 provides clearance for the flange 7 when the safety device 10 is installed onto an I-beam post 5.

Figure 5A:
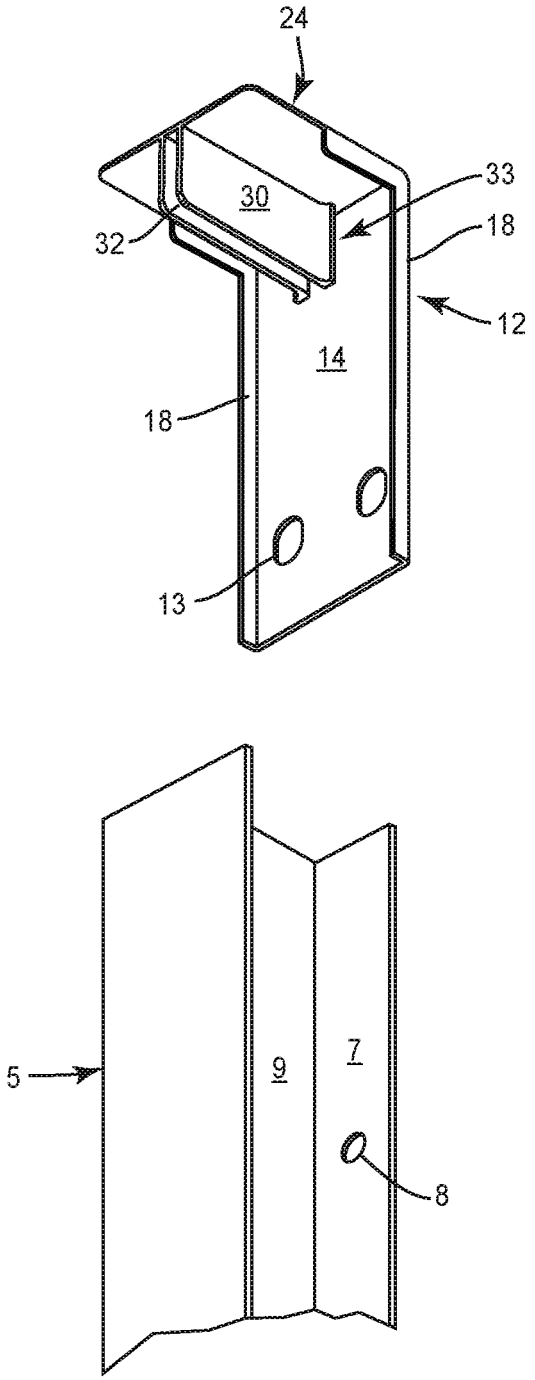
FIGS. 5A and 5B illustrate the safety device according to the first embodiment being installed on a support post.
Figure 5B:
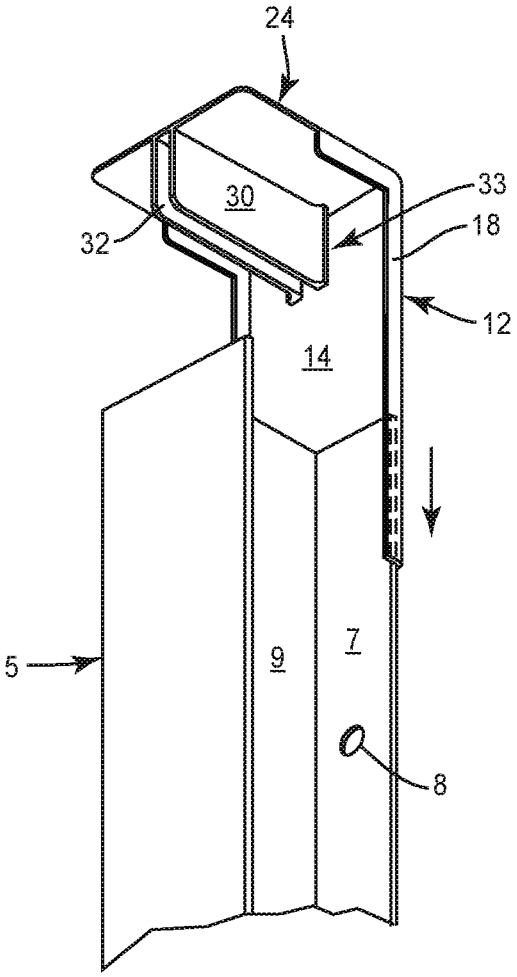
Figure 6:
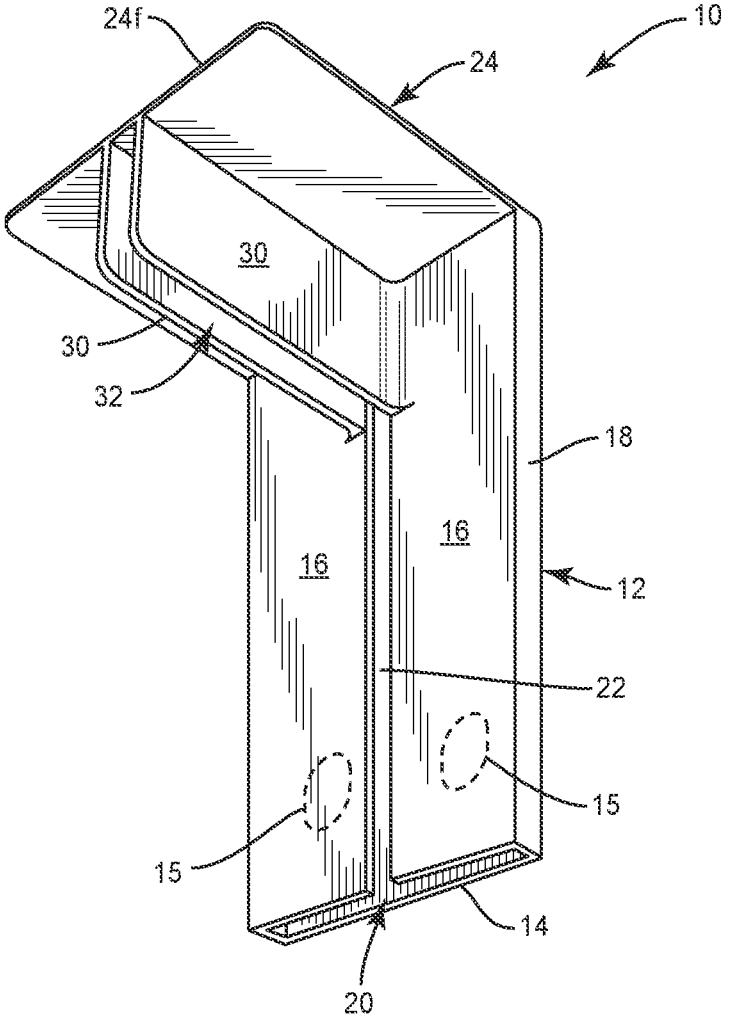
FIG. 6 is a perspective view of the safety device according to a second embodiment.
Figure 7:
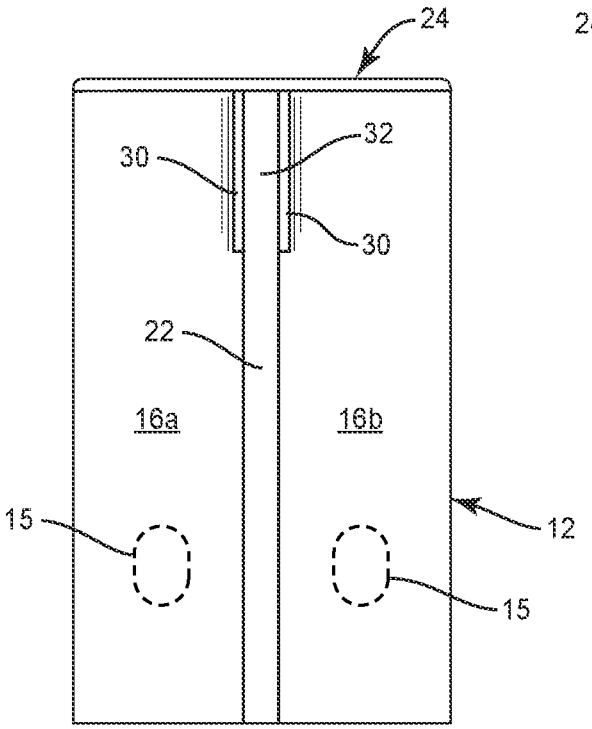
FIG. 7 is a rear view of the safety device according to the second embodiment.
Figure 8:
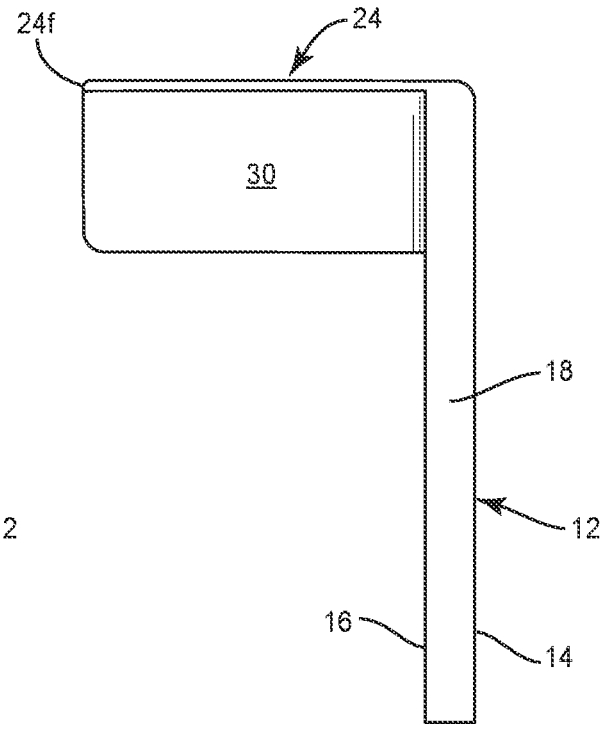
FIG. 8 is a side view of the safety device according to the second embodiment.
Figure 9:
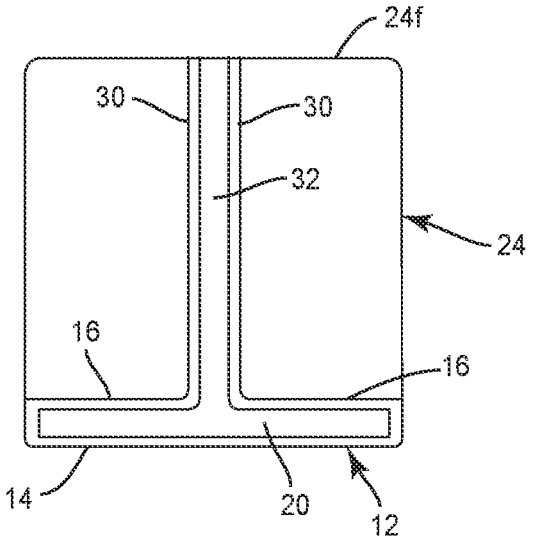
FIG. 9 is a bottom view of the safety device according to the second embodiment.

The safety device 10 is designed to slide over the end of an I-shaped support post 5 as shown in FIGS. 5A-5B. When the safety device 10 is installed onto the support post 5, web 9 of the support post 5 is received in the channel 32 between the side panels 30 and the flange 7 of the support post 5 extends into the gap 33 between the side panels 30 and the front wall 14 of the front pad 12. The safety device 10 is pressed down until flange 7 and/or web 9 engages the bottom surface of the top pad 24.

To secure the safety device 10 to the support post 5, a pair of holes 8 is formed or drilled in the flange 7 of the support post 5. Each hole 8 in the flange 7 of the support post 5 aligns with a corresponding hole 13 in the front wall 14. The safety device 10 is secured to the support post 5 by a pair of bolts, each of which passes through one set of aligned holes 8, 13 in the flange 7 and front wall 14 respectively. Nuts thread onto the ends of the bolts and are tightened against the inner surface of the flange 7.

Once installed, the safety device 10 of either embodiment provides cushioning in the event that a person falls into the support post 5. Additionally, the corners and edges of the safety device 10 are rounded so that there are no sharp corners or edges to hit. The safety device 10 is inexpensive to manufacture and easy to install, while protecting persons from serious injury.

FIGS. 6-9 illustrate a second embodiments of the safety device 10. The embodiment of FIGS. 6-9 comprises a front pad 12, a top pad 24, and a pair of side panels 30. In one embodiment, the front pad 12, top pad 24, and side panels 30 are molded as a single unit from a suitable material such as polyvinylchloride (PVC), low density polyethylene, polypropylene, polyurethane, polymeric foam materials, semi-rigid rubber, or other suitable materials. The material is preferably semi-rigid so that it will hold its form while providing some cushioning against impact. The edges and corners of the safety device 10 are preferably rounded to reduce the chance of injury.

The front pad 12 in this embodiment is generally tubular in form and comprises a front wall 14, back wall 16, and side walls 18. The front wall 14, back wall 16, and side walls 18 form a channel 20 that is configured to receive the flange 7 of the support post 5. The back wall 16 includes a slot 22 into which the web 9 of the support post 5 slides as shown in FIGS. 9A-9D. The slot 22 extends from the lower end of the front pad 12 to the top pad 24. Slot 22 divides the back wall 16 into two back wall portions 16*a* and 16*b*, each connected to a respective side wall.

The top pad 24 projects perpendicularly from the upper end of the front pad 12. In the embodiment shown in FIGS. 6-9, the top pad 24 comprises a generally planar panel that is rectangular in form. As previously noted, the top pad 24 could be almost any shape. The top panel 24 is designed and configured to cover the top end of the support post 5 as previously described.

The side panels 30 extend downward from the top pad 24 and rearward from the back wall 16 in a plane that is perpendicular to both the front pad 12 and top pad 24. IN this embodiment, the side panels 30 join with the back wall 16. The side panels 30 are disposed on opposite sides of the slot 22 in the back wall 16 of the front pad 12. The side panels 30 define a channel 32 that is open along two sides to receive the upper end of the web 9 of the support post 5. The channel 32 is sized so that the web 9 of the support post 5 fits snugly into the channel 32.

Figures 10A, 10B, 10C, 10D:
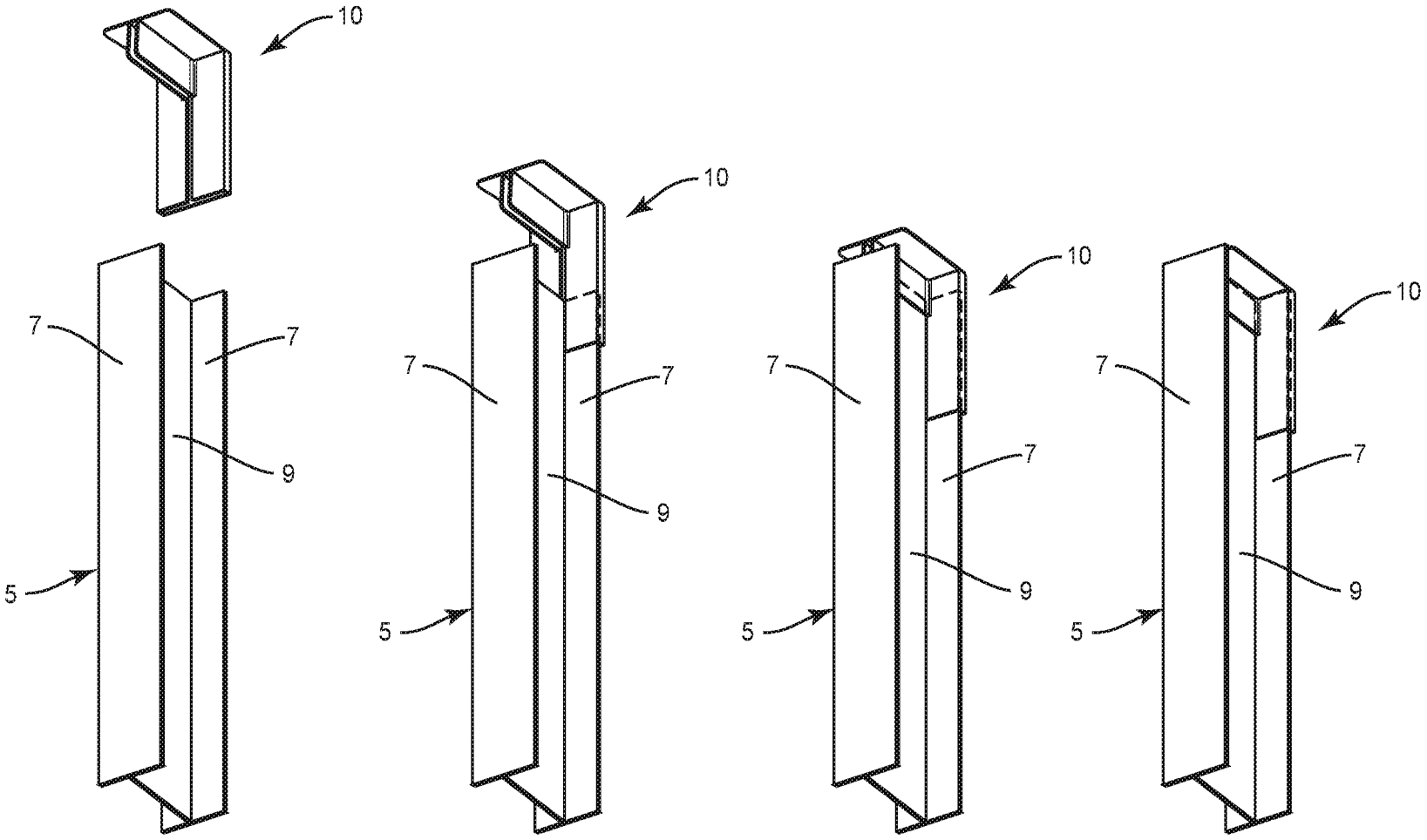
FIGS. 10A-10D illustrate the safety device being installed on a support post according to the second embodiment.
Figure 11:
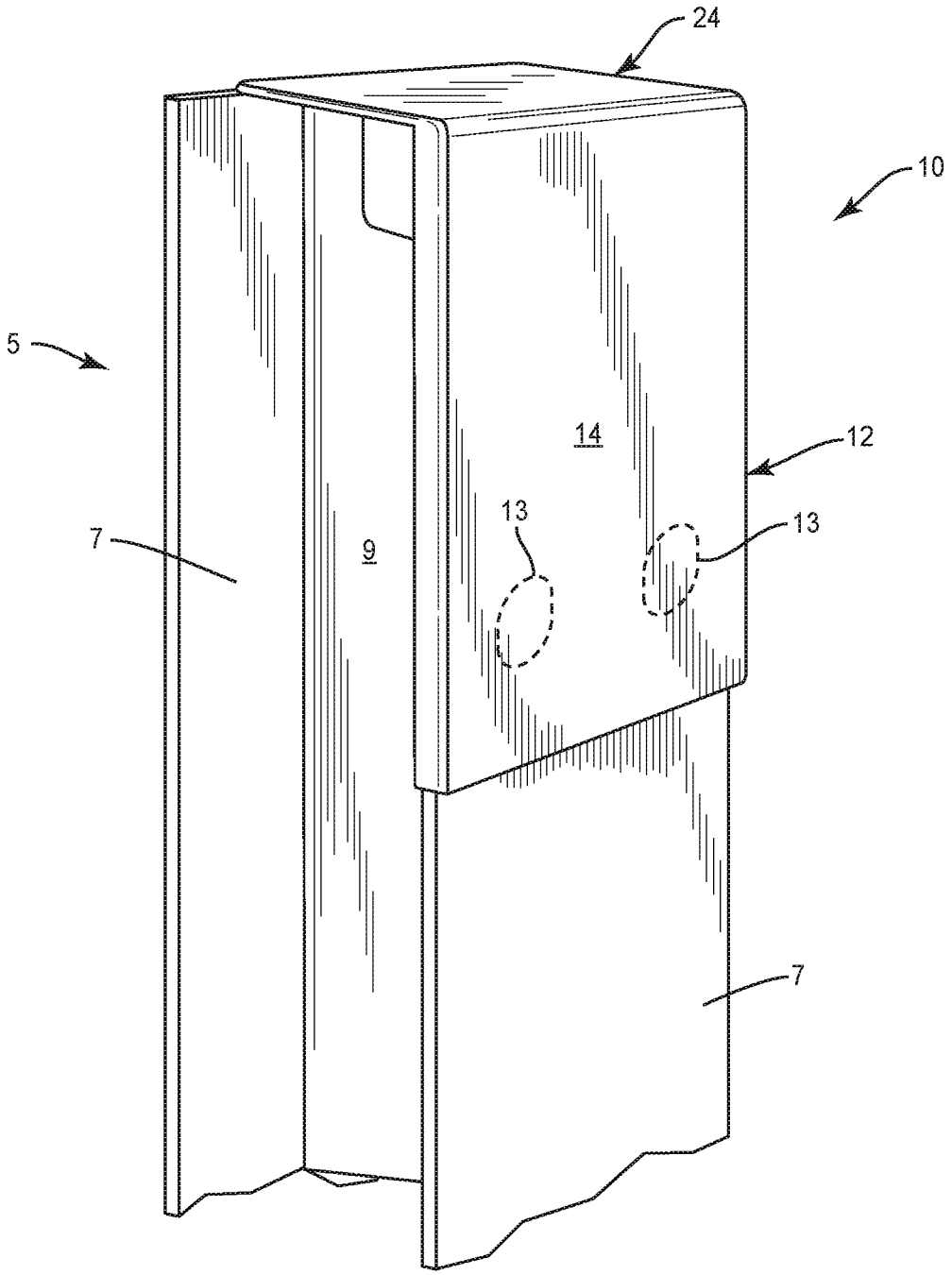
FIG. 11 is a perspective view of the safety device installed on a support post according to the second embodiment.

The safety device 10 is designed to slide over the end of an I-shaped support post 5 as shown in FIGS. 10A-10 D. The channel 20 in the front pad 12 is open at the lower end so that the front pad 12 can be inserted over the end of the flange 7 of the support post while the slot 22 provides clearance for the web 9. (FIGS. 10 A-10 B). The safety device 10 is then pushed downward onto the support post 5. While the safety device 10 is pushed down, the flange 7 of the support post 5 slides upwardly into the channel 20 while the web 9 slides in the slot 22 of the back wall 16 (FIG. 10 C). The safety device 10 is pressed down until flange 7 and/or web 9 engages the top pad 24 (FIG. 10 D).

In one variation of this embodiment, the channel 20 is sized to snugly fit the flange 7 of the support post 5. The snug fit between the front pad 12 and the flange 7 is sufficient to hold the safety device 10 in place. In another variation of this embodiment, the channel 20 in the front pad 12 is designed to loosely fit the flange 7 of the support post 5. In this case, aligned bolt holes 13, 15 (shown in dotted lines) may optionally be formed in the front wall 14 and back wall 16 of the front pad 12 respectively. In this variation, safety device 10 is secured to the support post 5 by a pair of bolts, each of which passes through one set of aligned holes 8, 13, 15 in the flange 7, front wall 14 and back wall 16 respectively. Nuts thread onto the ends of the bolts and are tightened against the inner surface of the back wall 16.

Once installed, the safety device 10 provides cushioning in the event that a person falls into the support post 5. Additionally, the corners and edges of the safety device 10 are rounded so that there are no sharp corners or edges to hit.

FIGS. 12-16 illustrate a third exemplary embodiment of the safety device 10. The safety device 10 according to a FIGS. 12-16 comprises a front pad 12, a top pad 24, and a pair of side panels 30. In one embodiment, the front pad 12, top pad 24, and side panels 30 are molded as a single unit from a suitable material such as polyvinylchloride (PVC), low density polyethylene, polypropylene, polyurethane, polymeric foam materials, semi-rigid rubber, or other suitable materials. The material is preferably semi-rigid so that it will hold its form while providing some cushioning against impact. The edges and corners of the safety device 10 are preferably rounded to reduce the chance of injury.

Figure 12:
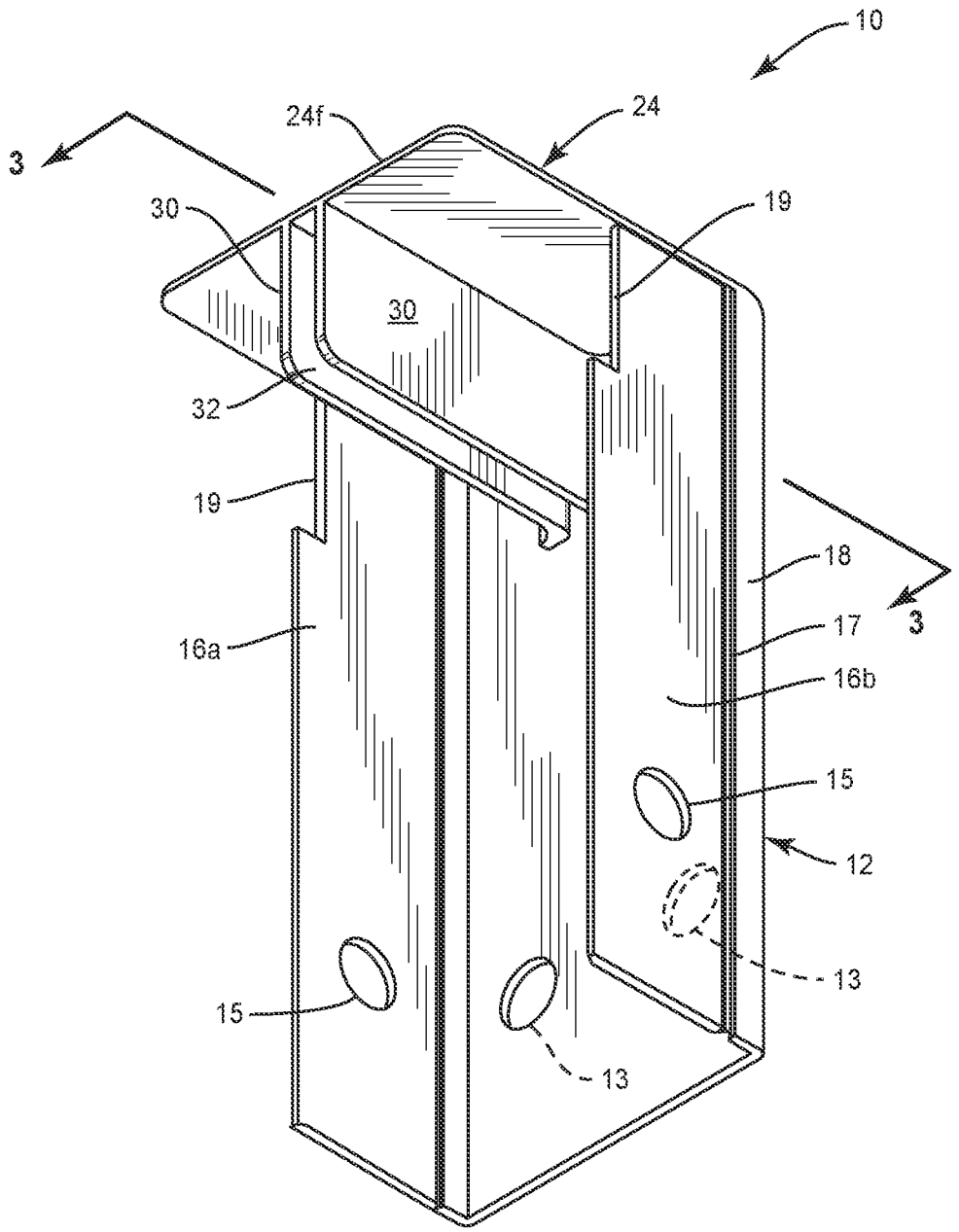
FIG. 12 is a rear perspective view of the safety device according to a third embodiment with the back walls of the front pad in open positions.
Figure 13:
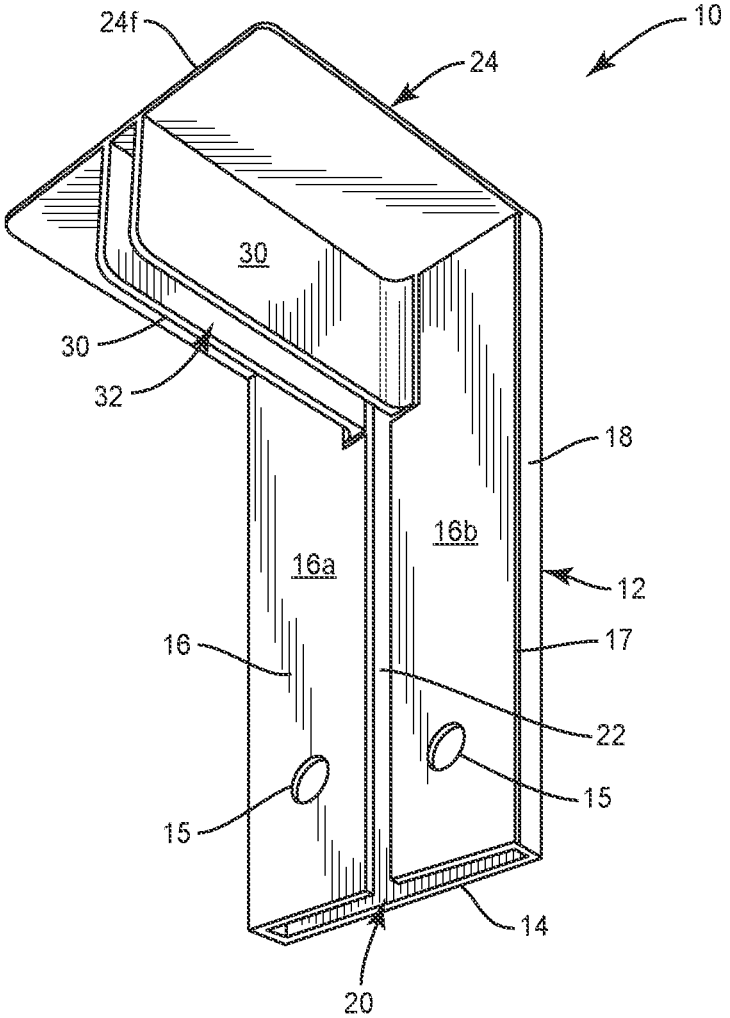
FIG. 13 is a rear perspective view of the safety device according to the third embodiment with the back walls of the front pad in closed positions.

The front pad 12 includes a front wall 14, back wall 16, and side walls 18. The front wall 14 comprises a generally planar panel and is configured to cover the outer surface of the flange 7 of the support post 5 when the safety device 10 is installed on the support post 5. The front wall 14 includes a pair of bolt holes 13 for securing the safety device 10 to the support post 5 as hereinafter described. The side walls 18 extend along respective edges of the front wall 14 and are configured to wrap around the side edges of the flange 7 when the safety device 10 is installed on the support post 5. The back wall 16 includes two back wall portions 16*a*, 16*b* connected to respective sidewalls 18 by live hinges 17 so as to be movable between an open position as shown in FIG. 12 and a closed position as shown in FIG. 13. When the back wall portions 16 are in the closed position, the front wall 14, back wall 16, and side walls 18 form a channel 20 that is configured to receive flange 7 of the support post 5. A slot 22 is formed between the edges of the back wall portions 16*a*, 16*b* allow the web 9 of the support post 5 to pass between the back wall portions 16*a*, 16*b*. Each back wall portion 16*a*, 16*b* includes a bolt hole 15 that aligns with a respective bolt hole 13 in the front wall 14 when the back wall portions 16*a*, 16*b* are in the closed position.

The top pad 24 projects perpendicularly from the upper end of the front pad 12. In the embodiment shown in the drawings, the top pad 24 is generally rectangular in form. However, those skilled in the art will appreciate that the form of the top pad 24 is not a material aspect of the invention and that the top pad 24 could have a variety of shapes. For example, the top pad 24 could be triangular, trapezoidal, oval, or virtually any other shape. The side edges of the top pad 24 could be straight or could be curvilinear.

Figure 14:
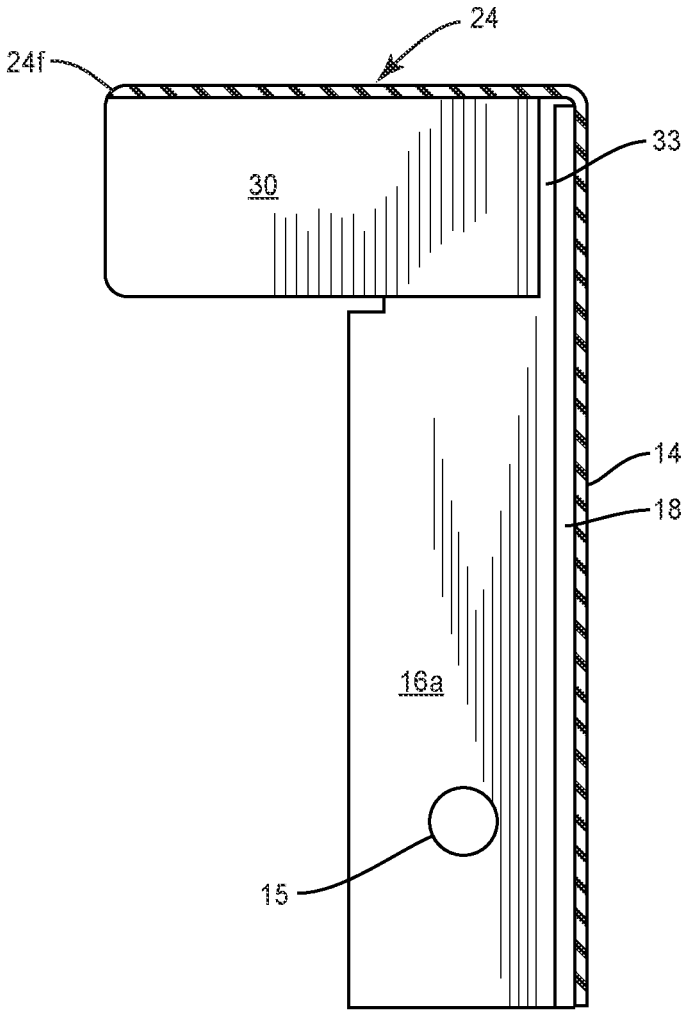
FIG. 14 is a section view of the safety device according to the third embodiment taken through line 3-3 of FIG. 12.
Figure 15:
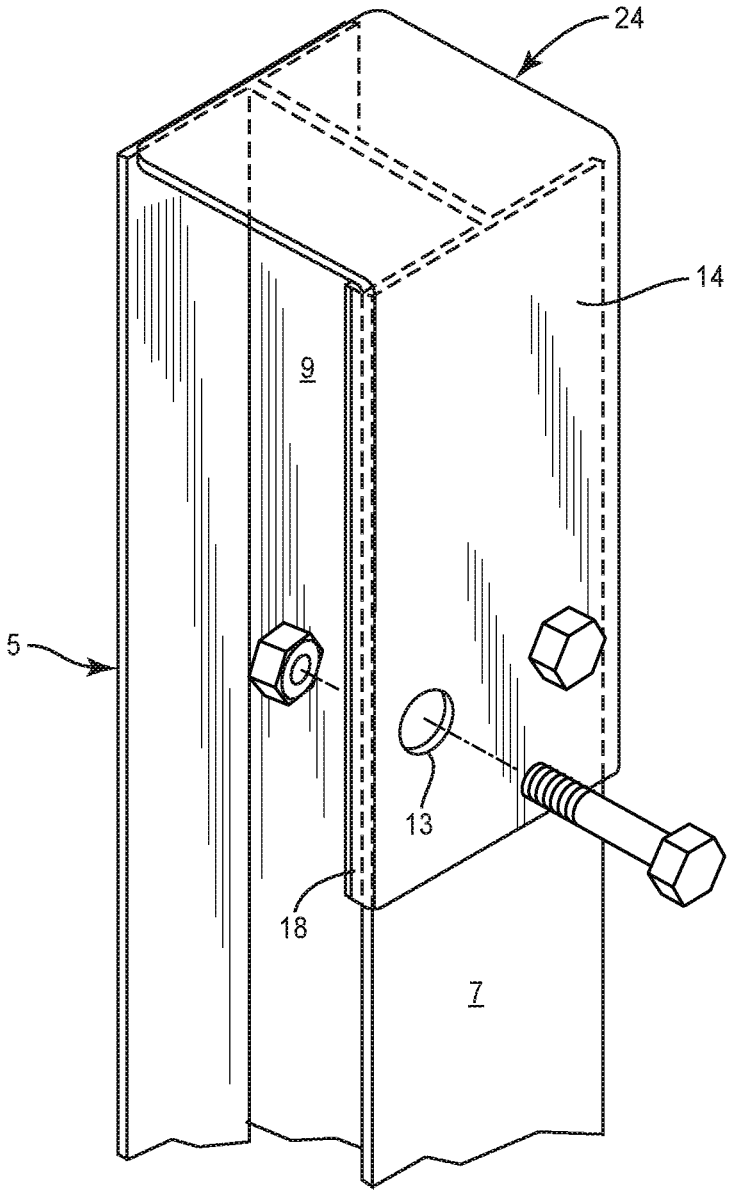
FIG. 15 is a front perspective view of the safety device according to the third embodiment installed on a support post.
Figure 16:
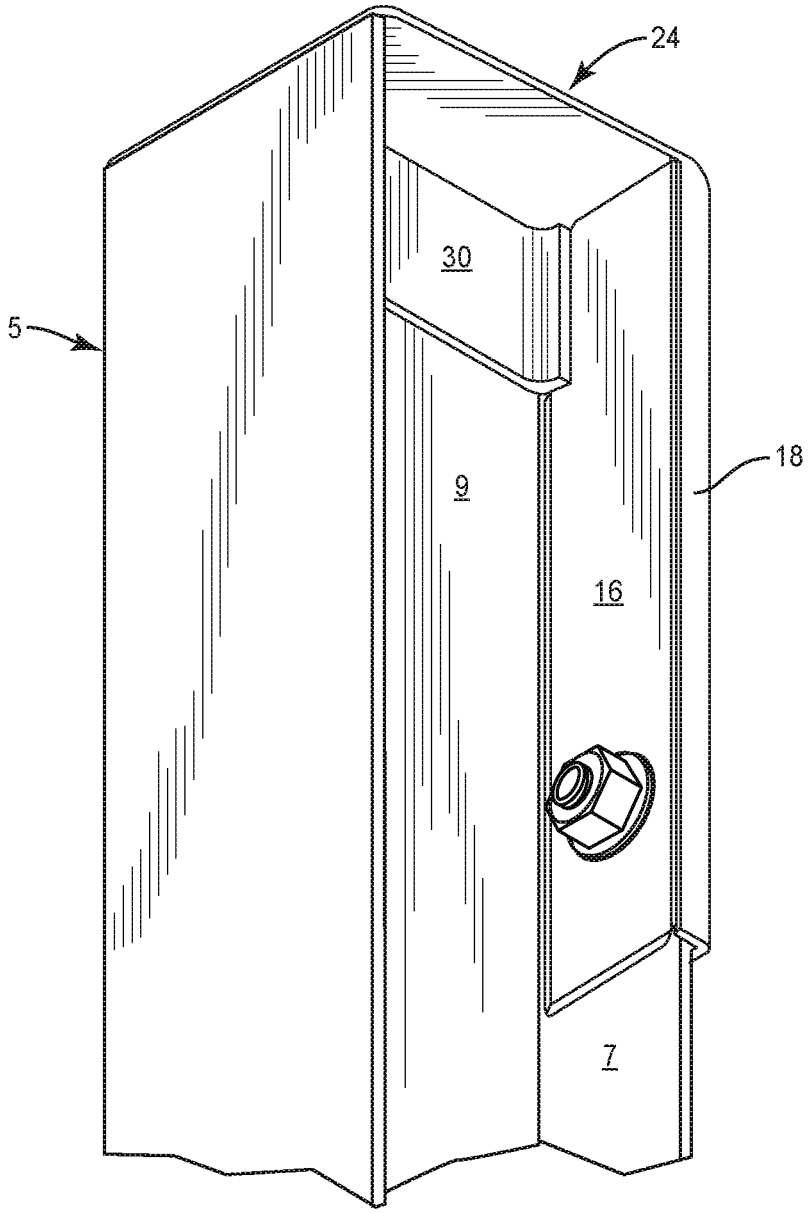
FIG. 16 is a rear perspective view of the safety device according to the third embodiment installed on a support post.

The side panels 30 extend downward from the top pad 24 in a plane that is perpendicular to both the front pad 12 and top pad 24 leaving a small gap 33 between the rear edge of the side walls and the front wall 14. The gap is best seen in FIG. 14. The gap 33 is sized to receive the flange 7 when the safety device 10 is installed on the support post 5. The side panels 30 define an open channel 32 that receives the upper end of the web 9 of the support post 5 when the safety device 10 is installed on the support post 5. The channel 32 is sized so that the web 9 of the support post 5 fits snugly into the channel 32.

Figure 17A:
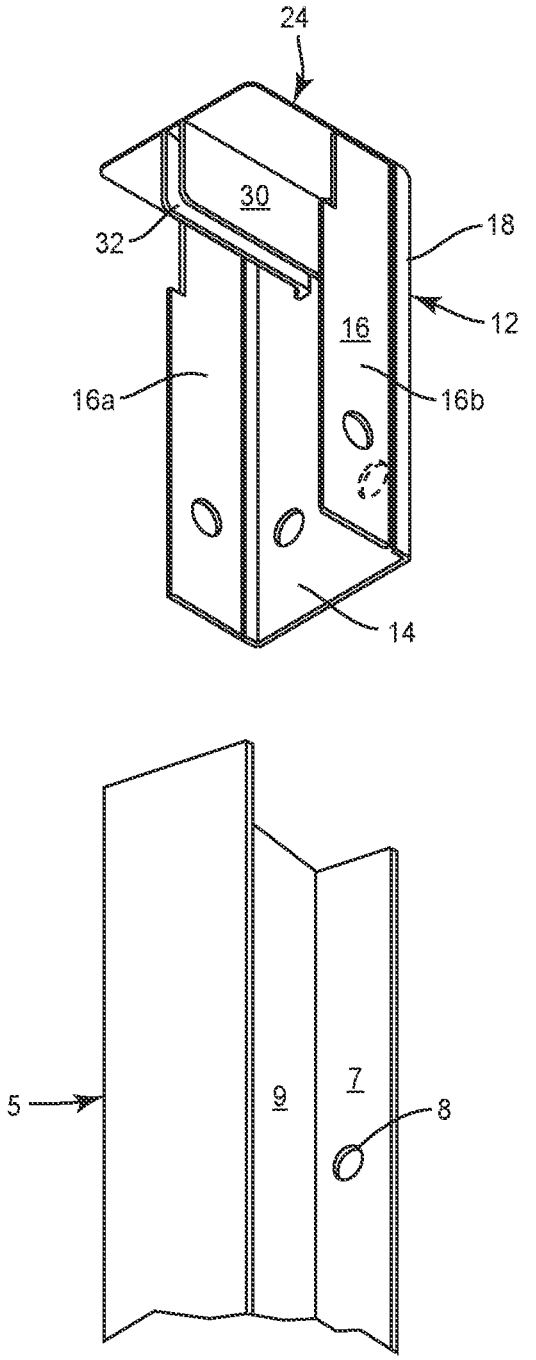
FIGS. 17A-17D illustrate the safety device according to the third embodiment being installed on a support post.
Figure 17B:
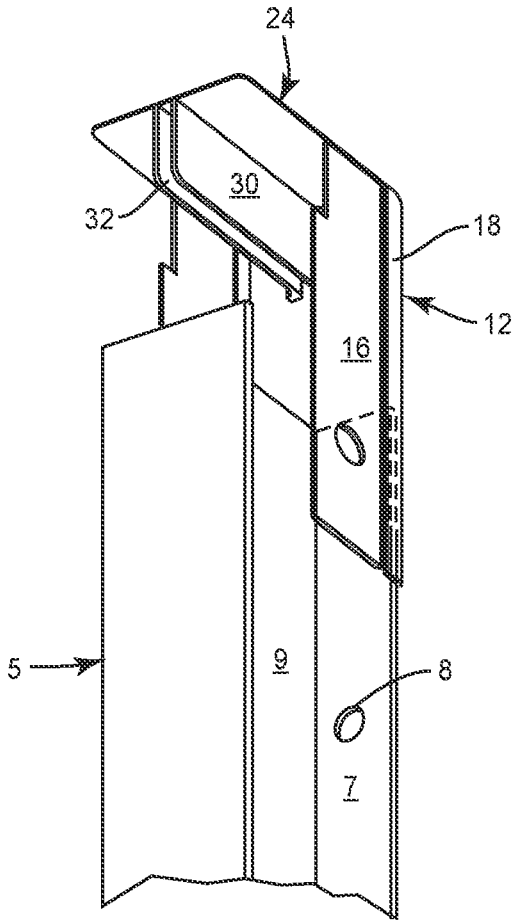
Figure 17C:
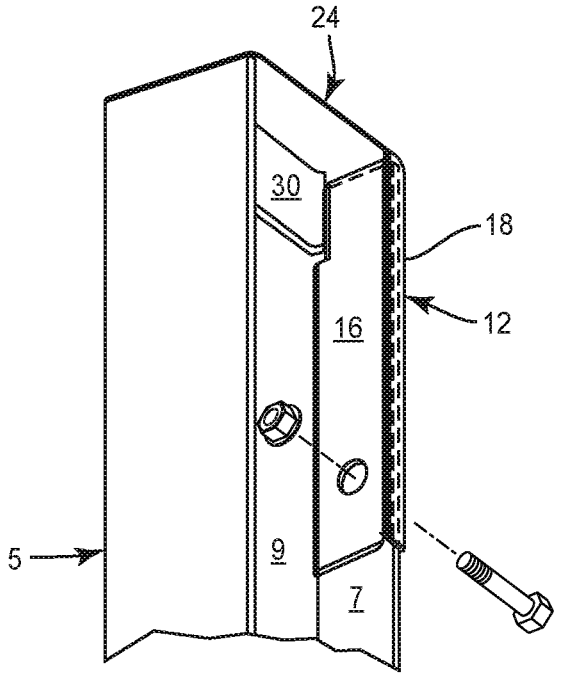
Figure 17D:
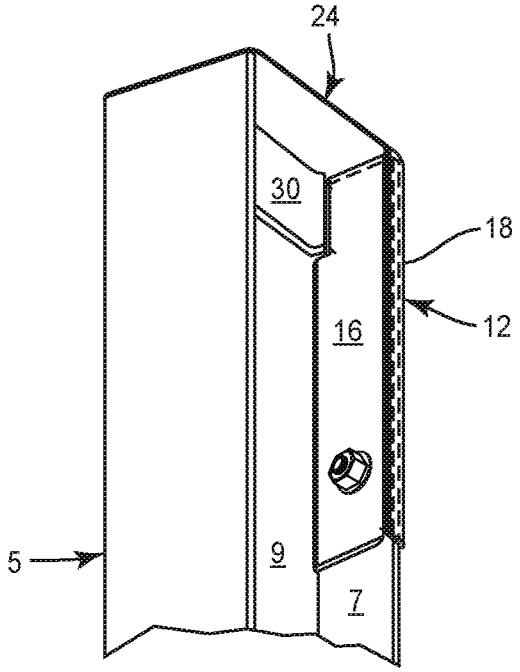

The safety device 10 is designed to be installed on the end of an I-shaped support post 5 as shown in FIGS. 17A-17D. As shown in FIGS. 17A and 17B, the safety device 10 is initially installed with the back walls 16 in an open position. The web 9 of the support post 5 is received in the channel 32 between the side panels 30 and the flange 7 of the support post 5 extends into the gap 33 between the side panels 30 and the front wall 14 of the front pad 12. The safety device 10 is pressed down until flange 7 and/or web 9 engages the top pad 24 (FIGS. 17C and 17D). The back walls 16 are folded inwardly to the closed position as shown in FIGS. 17C and 17D to overlap the flange 7. Notches 19 in the back walls 16 provide clearance for the side panels 30. To secure the safety device 10 to the support post 5, a pair of holes 8 is formed or drilled in the flange 7 of the support post 5. Each hole 8 in the flange 7 of the support post 5 aligns with a corresponding hole 13 in the front wall 14 and a hole 15 in a corresponding one of the back walls 17. The safety device 10 is then secured to the support post 5 by a pair of bolts, each of which passes through a respective hole 13 in the front wall 14 and a hole 15 in a respective back wall 17 as shown in FIGS. 17C and 17D.

The safety device 10 as herein described provides cushioning in the event that a person falls into the support post. Additionally, the corners and edges of the safety device 10 are rounded so that there are no sharp corners or edges to hit. Based on the foregoing, it is apparent that the safety device 10 is inexpensive to manufacture and easy to install, while protecting persons from serious injury.

What is claimed is:

1. A safety device for an I-shaped support post including two opposing flanges interconnected by a web, the safety device comprising:

a top pad configured to extend over a top end of the support post when the safety device is installed on the support post;

a front pad including a front wall configured to extend downwardly from the top pad along a first one of the flanges when the safety device is installed in the support post;

a pair of side panels extending downwardly from the top pad, the side panels defining a channel configured to receive the web of the support post when the safety device is installed on the support post with the front pad extending generally parallel to the first one of the flanges;

wherein the top pad extends longitudinally in cantilever fashion from the front pad and has a free end of the top pad disposed distally from the front pad;

wherein the front pad extends downwardly farther away from the top pad than the pair of side panels;

wherein the channel defined by the side panels is open ended in a direction from the front pad toward the free end of the top pad; and wherein the top pad, between the front pad and the free end of the top pad, extends laterally outboard beyond both of the pair of side panels.

2. The safety device of claim 1, further comprising a gap between the side panels and the front wall of the front pad to receive the first one of the flanges when the safety device is installed on the support post.

3. The safety device of claim 1, wherein the front wall includes a pair of laterally spaced openings to receive a pair of bolts for securing the safety device to the support post.

4. The safety device of claim 1, wherein the front pad further comprises two sidewalls extending along opposing edges of the front wall and configured to wrap around side edges of the first one of the flanges.

5. The safety device of claim 1, wherein the front pad comprises the front wall, side walls extending along lateral edges of the front wall, and a back wall defining a second channel to receive the first one of the flanges of the support post when the safety device is installed on the support post.

6. The safety device of claim 5, wherein the back wall includes a slot configured to receive the web of the support post when the safety device is installed on the support post.

7. The safety device of claim 6, wherein the back wall includes two back wall portions connected to respective side walls so as to be movable between an open position and a closed position; wherein in the closed position the front wall, side walls, and back wall define the second channel surrounding the first one of the flanges of the support post.

8. The safety device of claim 5, wherein the front wall includes at least one opening to receive a bolt for securing the safety device to the support post, and wherein the back wall includes an opening aligned with at least one opening in the front wall to receive the bolt.

9. The safety device of claim 1, wherein the pair of side panels are connected to the front pad only via the top pad.

10. The safety device of claim 1, wherein the top pad is rectangular in plan view, with a lateral width larger than a lateral width of the flanges of the support post.

11. A safety device for an I-shaped support post including first and second opposing flanges interconnected by a web, the safety device comprising:

a front pad configured to slide over an end of the support post, the front pad having a first channel configured to receive the first flange of the support post and a slot extending along one side of the front pad to receive the web of the support post; and a top pad projecting perpendicularly from one end of the front pad, the top pad being configured to extend over the end of the support post when the front pad is inserted onto the first flange of the support post;

a pair of side panels extending perpendicularly from the front pad and the top pad, the side panels defining a second channel configured to receive the web of the support post when the safety device is installed on the support post with the front pad extending generally parallel to the first flange;

wherein the top pad extends longitudinally in cantilever fashion from the front pad and has a free end of the top pad disposed distally from the front pad;

wherein the front pad extends downwardly farther away from the top pad than the pair of side panels;

wherein the second channel defined by the side panels is open ended in a direction from the front pad toward the free end of the top pad; and wherein the top pad, between the front pad and the free end of the top pad, extends laterally outboard beyond both of the pair of side panels.

12. The safety device of claim 11, wherein the top pad is rectangular in plan view, with a lateral width larger than a lateral width of the flanges of the support post.

13. The safety device of claim 11, wherein the front pad comprises a front wall, side walls extending along lateral edges of the front wall, and a back wall defining the first channel.

14. The safety device of claim 13, wherein the back wall includes a slot configured to receive the web of the support post when the safety device is installed on the support post.

15. The safety device of claim 14, wherein the back wall includes two back wall portion walls portions connected to respective side walls so as to be movable between an open position and a closed position; wherein in the closed position the front wall, side walls, and back wall define the first channel.

16. A safety device for an I-shaped support post including first and second opposing flanges interconnected by a web, the safety device comprising:

a top pad configured to extend over a top end of the support post when the safety device is installed on the support post;

a front pad having a first channel configured to receive the first flange of the support post, the front pad comprising:

a front wall configured to extend downwardly from the top pad along and parallel to the first flange when the safety device is installed in the support post;

a pair of side walls extending along opposing edges of the front wall; and a back wall;

a pair of side panels extending downwardly from the top pad, the side panels defining a second channel configured to receive the web of the support post when the safety device is installed on the support post when the safety device is installed on the support post with the front pad extending generally parallel to the first flange;

wherein the top pad extends longitudinally in cantilever fashion from the front pad and has a free end of the top pad disposed distally from the front pad;

wherein the front pad extends downwardly farther away from the top pad than the pair of side panels;

wherein the second channel defined by the side panels is open ended in a direction from the front pad toward the free end of the top pad; and wherein the top pad, between the front pad and the free end of the top pad, extends laterally outboard beyond both of the pair of side panels.

17. The safety device of claim 16, wherein the back wall includes a slot configured to receive the web of the support post when the safety device is installed on the support post.

18. The safety device of claim 17, wherein the back wall includes two back wall portions connected to respective side walls so as to be movable between an open position and a closed position; wherein in the closed position the front wall, side walls, and back wall define the first channel.

19. The safety device of claim 16, wherein the top pad is rectangular in plan view, with a lateral width larger than a lateral width of the flanges of the support post.

* * * * *